US007815842B2

(12) United States Patent
Okuzaki et al.

(10) Patent No.: US 7,815,842 B2
(45) Date of Patent: Oct. 19, 2010

(54) METHOD FOR PRODUCING CONDUCTING POLYMER FIBERS WITH VINYL AND CONDUCTING POLYMER FIBERS WITH VINYL PRODUCED THEREBY

(75) Inventors: Hidenori Okuzaki, Kofu (JP); Takashi Aoyama, Tokyo (JP); Tomiya Abe, Tokyo (JP); Yuzo Ito, Tokyo (JP)

(73) Assignees: Yamanashi University, Kofu-shi (JP); Hitachi Cable Ltd., Tokyo (JP)

( * ) Notice: Subject to any disclaimer, the term of this patent is extended or adjusted under 35 U.S.C. 154(b) by 1143 days.

(21) Appl. No.: 11/132,231

(22) Filed: May 19, 2005

(65) Prior Publication Data

US 2005/0287366 A1 Dec. 29, 2005

(30) Foreign Application Priority Data

May 20, 2004 (JP) ..... 2004-151021

(51) Int. Cl.
*B29C 47/88* (2006.01)
*D01D 5/00* (2006.01)

(52) U.S. Cl. ..... 264/465; 264/211.17

(58) Field of Classification Search ..... 264/465, 264/210.5, 211.17, 484
See application file for complete search history.

(56) References Cited

U.S. PATENT DOCUMENTS 3,706,677 A * 12/1972 Wessling et al. ..... 428/220
4,868,284 A * 9/1989 Murase et al. ..... 528/481
2001/0045547 A1* 11/2001 Senecal et al. ..... 252/501.1
2002/0089094 A1* 7/2002 Kleinmeyer et al. ..... 264/465

FOREIGN PATENT DOCUMENTS

| | | |
|---|---|---|
| EP | 0 005 035 | 10/1979 |
| JP | 54-151675 | 11/1979 |
| JP | 5-159979 | 6/1993 |
| JP | 2003-128937 | 5/2003 |
| JP | 2004-68161 A | 3/2004 |
| WO | WO 2004/074559 A1 * | 9/2004 |

OTHER PUBLICATIONS

Takui Takahashi et al.; Fabrication of Functional Polymer Nanofibers by Electrospinning, Engineering Materials, vol. 51, No. 9, pp. 34-37, 2003.
Yoshihiro Yamashita et al.; Characteristics of Elastomeric Nanofiber Membranes Produced by Electrospinning (1F05), Fiber Preprints, Japan, vol. 59, No. 1, p. 83, 2004.
English translation of Office Action issued on Jun. 30, 2009 in corresponding Japanese Application JP2004-151021.
English translation of Office Action issued on Oct. 5, 2009 in corresponding Japanese Application JP2004-151021.

* cited by examiner

*Primary Examiner*—Michael A Tolin
(74) *Attorney, Agent, or Firm*—Birch, Stewart, Kolasch & Birch, LLP

(57) ABSTRACT

The vinyl-type conducting polymer precursor is dissolved in solution containing volatile solvent such as methanol, and the precursor fibers are produced by electrospinning. The vinyl-type conducting polymer fibers are produced by heat treatment of the precursor fibers at certain temperature and time in a vacuum or in an inert gas atmosphere, or by zone reaction method, followed by doping with dopant.

18 Claims, 5 Drawing Sheets

$R_2 = S^+(CH_3)_2X^-, S^+(C_2H_5)_2X^-, S^+(C_3H_7)_2X^-, S^+(CH_2)_4X^-$
$OCH_3, OC_2H_5, OC_3H_7$ $X^- = Cl^-, Br^-, I^-, OH^-$

METHOD FOR PRODUCING CONDUCTING POLYMER FIBERS WITH VINYL AND CONDUCTING POLYMER FIBERS WITH VINYL PRODUCED THEREBY

BACKGROUND OF THE INVENTION

1. Field of the Invention

This invention deals with the method for producing vinyl-type conducting polymer fibers and vinyl-type conducting polymer fibers produced thereby, especially by electrospinning of a precursor of vinyl-type conducting polymer dissolved in volatile solvent and vinyl-type conducting polymer fibers produced thereby.

2. Description of the Related Art

The electrospinning is a method for producing fibers by application of a high voltage to polymer melt or solution. Since the electrospinning is capable of producing fibers with diameters between nano- and micrometers without exploiting vacuum and heating equipment, there are a number of reports in recent years.

For example, there are reports on electrospinning of polyacrylonitrile (PAN), poly(L-lactic acid) (PLA), and polyethyleneoxide (PEO). (Non-patent document 1: Takui Takahashi and Hidenori Okuzaki, "Fabrication of Functional Polymer Nanofibers by Electrospinning", Engineering Materials, 51(9), 34-37, (2003)).

There are also reports demonstrating that the applied voltage, polymer concentration, distance between tip of the nozzle and the target, and shape of the tip of the nozzle are important for electrospinning of amorphous polymers such as polybutadiene, polystyrene-polybutadiene alloy, and widely-used polystyrene. (Non-patent document 2: Yoshihiro Yamashita, Akira Tanaka, and Frank Ko, "Characteristics of Elastomeric Nanofiber Membranes Produced by Electrospinning (1F05)", Fiber Preprints, Japan, 59(1), 83 (2004)).

For other examples, electrospinning applied to copolymers, composites, organic-inorganic hybrid materials is also reported, and in recent years, there are reports on applications to catalysts, membranes for separation, sensors, materials for medical application, biomaterials, and drug delivery devices utilizing an extremely large surface area of the nanofabric produced by electrospinning.

The production method of fibers with diameters between several tens to several hundreds nanometers by electrospinning of natural Bombyx mori silk fibers is released in the Japanese Laid-open patent publication described below. Herein hexafluoroacetone hydrate is the most suitable solvent to produce recombinant hybrid silk fibers by electrospinning without reducing the molecular weight with superior mechanical properties of the silk or silk-like fibers, and which is achieved by electrospinning of a solution of silk or silk-like materials in air dissolved in this solvent. (Patent document 1: Japanese Laid-open patent publication No. 2004-068161) On the other hand, nanofibers of organic semiconducting materials such as poly(p-phenylenevinylene) (PPV) is necessary for the development of organic electronics in the next generation, such as organic electroluminescence, organic transistors, and organic solar cells. Although the production of fibers by electrospinning is the conventional technique as described above, the electrospinning of PPV to form fibers is considered to be impossible because of its infusible and intractable properties. There is also no report on producing PPV fibers by electrospinning.

If high conducting, mechanically high-strength, and stable fibers such as PPV were easily produced in a nanometer-size, the development of organic electronic devices in the next generation such as organic electroluminescence, organic transistors, and organic solar cells would be promoted. Furthermore, conducting polymers are expected as an antenna of IC tags and electrical wires of an existing IC tip instead of metals.

BRIEF SUMMARY OF THE INVENTION

A first object of this invention is to provide a method for conducting polymer fibers with vinyl considered to be impossible to electrospin because it is infusible and intractable.

A second object of this invention is to provide high-strength and high conducting fibers of vinyl-type conducting polymers by electrospinning.

This invention features a production of vinyl-type conducting polymer fibers described in general formula (2) by electrospinning of a precursor of the vinyl-type conducting polymer described in general formula (1) dissolved in a solution containing a volatile solvent and subsequent thermal conversion of the precursor fibers:

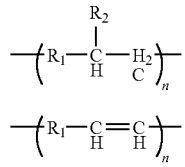

(1)

(2)

wherein, in formulas (1) and (2), R1 represents an aromatic or hetero-cyclic hydrocarbon, and R2 an elimination group.

Herein, for example, R1 is at least one chosen from benzene, naphthalene, anthracene, pyrene, azulene, fluorene, isothianaphthene, ethylenedioxythiophene, pyrrole, thiophene, furan, cerenophene, tellurophene, and their derivatives. Above all, stable, reliable, and easily synthesized benzene is the most suitable.

For R2, at least one is chosen from alkylsulfonium salts such as dimethylsulfonium salt, diethylsulfonium salt, dipropylsulfonium salt, and tetrahydrothiophenium salt, alkoxy groups such as methoxy group, ethoxy group, and propoxy group, and their derivatives. $X^-$ shown in FIG. 1 is at least one chosen from chloride ion, bromide ion, and iodide ion. Above all, easily synthesized and reliable tetrahydrothiophenium chloride is preferable.

The aforementioned solution is preferable to contain 40-90 wt % of volatile solvent. As volatile solvent, at least one compound is chosen from alcohols, ketones, aldehides, nitryls, ethers, dimethylformamides, and alkyl monohalides.

The aforementioned applied voltage for electrospinning is the values that deforms the solution into Taylor cone at the tip of the nozzle and result in a jet toward the counter electrode, and is preferably 10-30 kV. Moreover, the aforementioned heat treatment is preferably performed above 200° C. for longer than 1 hour.

When the aforementioned precursor fibers are heat-treated in a vacuum or in an inert gas atmosphere, the vinyl-type conducting polymer fibers are formed by elimination of side chains to form vinyl groups. The heat treatment of the precursor fibers in atmospheric air causes thermal decomposition or aging due to oxidation, and consequently, decreases the strength and conductivity. Therefore, the heat treatment in a vacuum or in an inert gas atmosphere is preferable.

The aforementioned heat treatment can be performed on the aforementioned precursor fiber in air by successive heating of a part of the precursor fibers under application of a tension.

This method (zone reaction method) has the following advantages: the heat and tension act locally and effectively on the fiber; the thermal decomposition or oxidation of the fiber can be minimized because the heating time is very short, about a few seconds; and vacuum equipment is unnecessary because the heat treatment can be performed in air.

When dopant is added to the fiber obtained by the aforementioned production method of vinyl-type conducting polymers (doping), the conductivity is remarkably improved than that before doping. The dopant used in the doping is, for example, at least one chosen from sulfuric acid, hydrochloric acid, nitric acid, phosphoric acid, iodine, bromine, arsenic fluoride, perchloric acid, tetrafluoroboric acid, hexafluorophosphoric acid, toluenesulfonic acid, dodesylbenzenesulfonic acid, perfluorosulfonic acid, polystyrenesulfonic acid, and their derivatives. Above all, sulfuric acid is preferable because high conductivity can easily be achieved.

The diameter of vinyl-type conducting polymer fiber produced by the aforementioned method varies from several tens nanometer to several micrometer. Controlling the applied voltage, concentrations of the precursor and solvent in the solution, the shape of the nozzle emitting a jet of the solution, and the distance between the electrodes can regulate the diameter of fiber.

This invention features a production of conducting polymer fibers, with diameters between several tens nanometer and several micrometer, obtained by the aforementioned production method of vinyl-type conducting polymer fibers.

According to this invention, the infusible and intractable vinyl-type conducting polymer fibers can be produced with extremely simple equipment at room temperature in air. Moreover, this invention is an excellent technique because the resulting conducting polymer fibers exhibit high electrical conductivity and superior mechanical strength.

DETAILED DESCRIPTION OF THE INVENTION

The technical terms used here in the specification are defined as follows.

The vinyl-type conducting polymer precursor denotes a precursor of vinyl-type conducting polymer consisting of aromatic or hetero-cyclic hydrocarbon in main chains and vinyl groups formed by elimination of side chains.

The vinyl-type conducting polymer fibers denote fibrous conducting polymers with vinyl groups produced by elimination of side chains of the vinyl-type conducting polymer precursor.

The electrospinning is the method to spin fibers using high voltages, where charges are induced and accumulated on the surface of the solution by application of a high voltage. These charges repel each other and compete with surface tension. If the electrostatic force exceeds a critical value, repulsion between charges becomes larger than the surface tension, a jet of the charged solution is emitted. The solvent is effectively evaporated since the jet has a large surface area compared with the volume, and the decrease volume enhances the charge density, leading to split into finer jets. This is the production method of fibers through this process.

Figure 1:
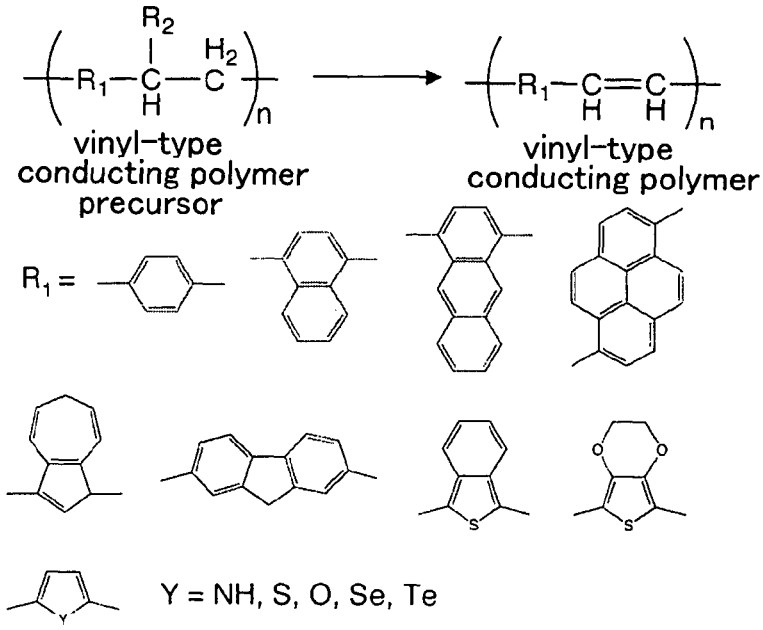
FIG. 1 illustrates chemical structures of general vinyl-type conducting polymers that can be synthesized from precursor.

FIG. 1 shows chemical structures of general vinyl-type conducting polymers that can be synthesized from a precursor. For R1, at least one is chosen from benzene, naphthalene, anthracene, pyrene, azulene, fluorene, isothianaphthene, ethylenedioxythiophene, pyrrole, thiophene, furan, cerenophene, tellurophene, and their derivatives. Above all, stable, reliable, and easily synthesized benzene is the most suitable.

For R2, at least one is chosen from alkylsulfonium salts such as dimethylsulfonium salt, diethylsulfonium salt, dipropylsulfonium salt, and tetrahydrothiophenium salt, alkoxy groups such as methoxy group, ethoxy group, and propoxy group, and their derivatives. $X^-$ is at least one chosen from halogen ion such as chloride ion, bromide ion, and iodide ion or hydroxide ion. Above all, easily synthesized and reliable tetrahydrothiophenium chloride is preferable.

To produce vinyl-type conducting polymer fibers, first of all, precursor of vinyl-type conducting polymer is dissolved in solvent mixed with at least one chosen from water, pure water, or volatile solvent such as alcohols, ketones, aldehides, nitryls, ethers, dimethylformamides, alkyl monohalides.

Figure 2:
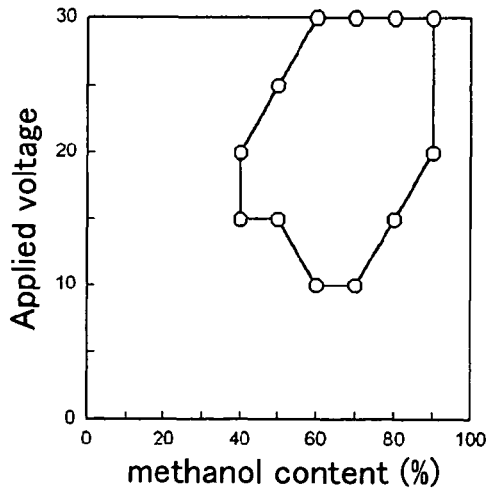
FIG. 2 shows conditions for fiber formation by electrospinning of water/methanol mixed solution of vinyl-type conducting polymer precursor.

FIG. 2 shows conditions for fiber formation by electrospinning of a water/methanol mixed solution of vinyl-type conducting polymer precursor. Although the fiber is formed in the methanol content from 0 to 99%, at lower methanol content, the solvent remains in the deposit on the target since the vinyl-type conducting polymer precursor strongly retains water. On the other hand, when the methanol content is much higher, the concentration of vinyl-type conducting polymer precursor is too low to form fibers. The 40-90% of methanol content is preferable taking account of the rate of fiber formation and drying condition.

To jet the solution from the nozzle by electrospinning, high voltages are applied between the nozzle and the target electrode placed on the substrate to which the charged droplets emitted from the nozzle are deposited.

At low applied voltage, a jet is not formed because the electrostatic force cannot overcome the surface tension of the solution, or even if a jet is formed, good fibers are not produced because the solution does not take enough charges to evaporate the solvent completely before reaching the target. On the other hand, at much higher applied voltage, good fibers are not also produced because the charged droplets are pulled too strongly to evaporate the solvent before reaching the target. Above all, 10-30 kV of applied voltage is preferable taking account of stability of jet and volatility of solvent.

The vinyl-type conducting polymer precursor produced by electrospinning is heat-treated in a vacuum or in an inert gas atmosphere. By the heat treatment, R2, the side chain of the general formula of the vinyl-type conducting polymer precursor shown in FIG. 1, and $X^-$ are eliminated to form vinyl groups, which produces the vinyl-type conducting polymer fibers. The heat treatment of the precursor fibers in atmospheric air causes thermal decomposition or aging due to oxidation, and consequently, results in decreases of fiber strength and conductivity. Therefore, the heat treatment in a vacuum or in an inert gas atmosphere is preferable.

The aforementioned heat treatment can be performed on the aforementioned precursor fiber in air by successive heating of a part of the precursor fibers under application of a tension.

This method (zone reaction method) has the following advantages: the heat and tension act effectively on the quite narrow area of the fiber; the thermal decomposition or oxidation of the fiber can be minimized because the heating time is very short, about a few seconds; and a vacuum equipment is unnecessary because the heat treatment can be performed in air.

When dopant is added to the fiber obtained by the aforementioned production method of vinyl-type conducting polymers (doping), the conductivity is remarkably improved than that before doping. The dopant used in the doping is, for example, at least one chosen from sulfuric acid, hydrochloric acid, nitric acid, phosphoric acid, iodine, bromine, arsenic fluoride, perchloric acid, tetrafluoroboric acid, hexafluorophosphoric acid, toluenesulfonic acid, dodesylbenzenesulfonic acid, perfluorosulfonic acid, polystyrenesulfonic acid, and their derivatives. Above all, sulfuric acid is preferable because high conductivity can easily be achieved.

The diameter of vinyl-type conducting polymer fiber produced by the aforementioned method varies from several tens nanometer to several micrometer. Controlling the applied voltage, concentrations of the precursor and solvent in the solution, the shape of the nozzle emitting a jet of the solution, and the distance between the electrodes can regulate the diameter of fiber.

EXAMPLE 1

This invention is elucidated in more detail using examples, but not be limited hereby.

Figure 3:
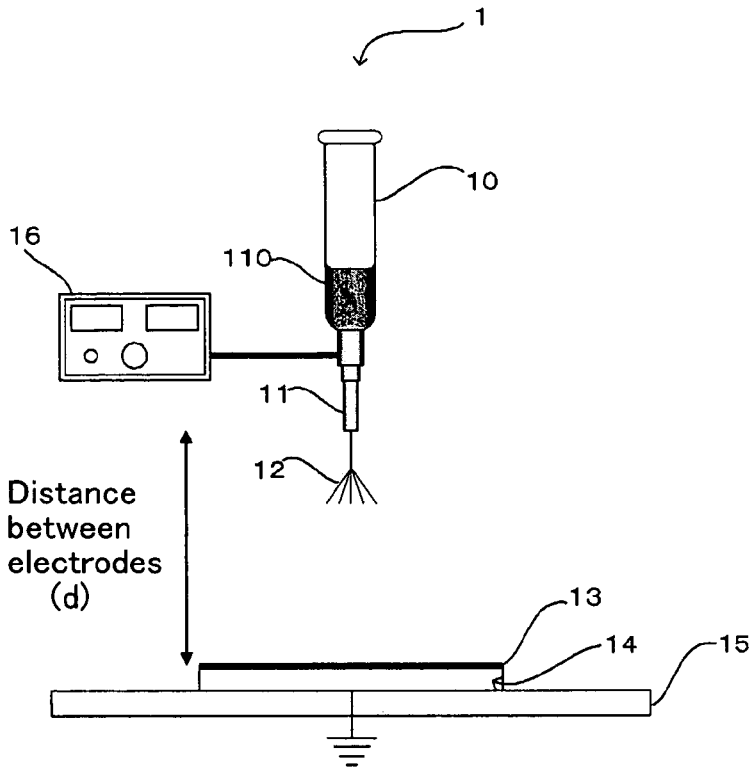
FIG. 3 illustrates a construction of apparatus used for examples.

FIG. 3 shows construction of apparatus (1) used for examples. In this example, 2.5% aqueous solution (110) of poly(p-xylenetetrahydrothiophenium chloride) (Aldrich, 54076-5), precursor of poly(p-phenylenevinylene) (PPV), is used as a precursor of vinyl-type conducting polymer.

Methanol is added to the solution of vinyl-type conducting polymer precursor (110), and about 1 ml of the mixed solution is poured into a glass syringe (10), 90 mm long and 1.2 mm in inner diameter, (volume: 5 ml, Top Glass Syringe, Top Inc.) A high-voltage power supply (16) (Towa Keisoku Inc.) is connected to an injection needle, 50 mm long, 340 μm in diameter, and 90°-cut, made of stainless steel (11) (compatible needle for microsyringe, 23G50 mm 90°, Ito Seisakujyo Inc.) attached to the glass syringe (10), and DC voltage of 0~30 kV is applied.

As a target electrode (14), a center-grounded stainless plate, 100 mm×100 mm and 1 mm thick, covered with a 12 μm-thick aluminum foil (13) (Sumikei Aluminum-Foil Inc.) is used. The material of the target is not limited.

Underneath the target electrode (14), a rubber sheet (15), 300 mm×300 mm and 10 mm thick, is placed for insulating. The distance between the electrodes is variable and is kept at 200 mm in this example.

Figure 4:
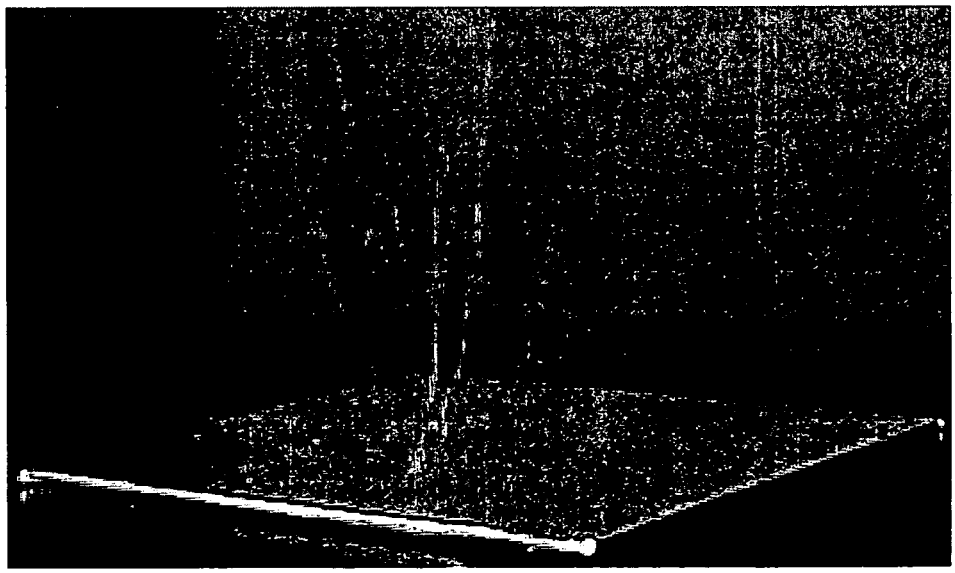
FIG. 4 shows image of precursor fiber formation of vinyl-type conducting polymer by electrospinning.

FIG. 4 shows the formation of vinyl-type conducting polymer precursor by electrospinning. Upon application of an electric voltage on top of the injection needle (11), the solution of poly(p-xylenetetrahydrothiophenium chloride) deforms into a conical shape, namely the Taylor cone, then a jet is formed when the electrostatic attractive force overcomes the surface tension and pulled to the target electrode (14).

The solution is charged and divided into small droplets due to the electrostatic repulsion. The solvent in the droplet immediately evaporates because of its large surface area, and then the poly(p-xylenetetrahydrothiophenium chloride) solution is solidified to form solid fibers deposited on the target electrode (14).

As a comparative experiment, the electric voltage was applied to the poly(p-xylenetetrahydrothiophenium chloride) solution without methanol and found that mist of the solution including a few amount of solid fibers was deposited to the aluminum foil (13) on the target electrode (14). This is considered that the polyelectrolyte, poly(p-xylenetetrahydrothiophenium chloride), and counter ions are strongly hydrated and evaporation of solvent does not occur completely within the time to reach the target electrode.

On the other hand, by addition of organic solvent such as methanol to the aqueous solution of poly(p-xylenetetrahydrothiophenium chloride), the solid fibers are formed as shown in FIG. 4. This is considered the methanol lowers the surface tension of the poly(p-xylenetetrahydrothiophenium chloride) solution and enhances the volatility of solvent.

Figure 5:
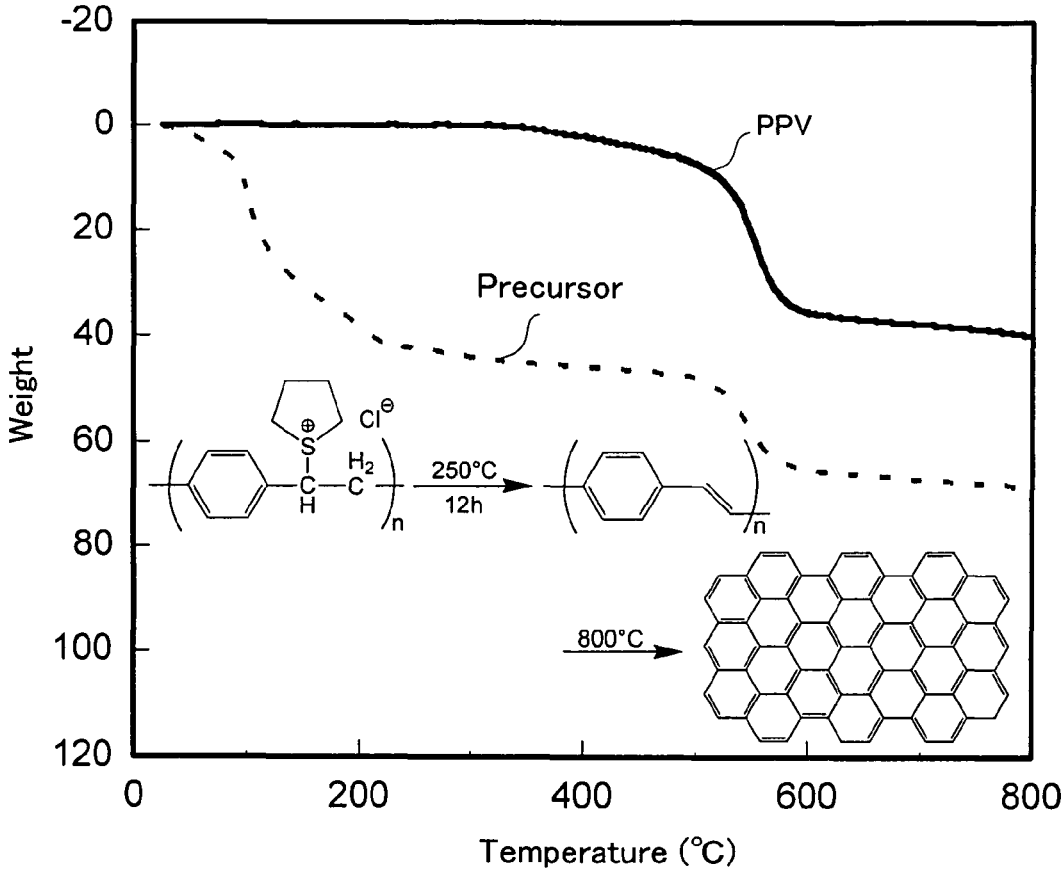
FIG. 5 shows thermogravimetric curves of precursor and vinyl-type conducting polymer fibers produced by heat treatment at 250° C. for 12 h in a vacuum.

FIG. 5 shows thermogravimetric curves of poly(p-phenylenevinylene) (PPV) prepared by heat treatment of poly(p-xylenetetrahydrothiophenium chloride) solid fibers produced by the aforementioned method at 250° C. for 12 h in an vacuum. The solid line in FIG. 5 represents the PPV prepared at 250° C. for 12 h in a vacuum and the broken line represents the solid fibers of poly(p-xylenetetrahydrothiophenium chloride).

As shown in FIG. 5, poly(p-xylenetetrahydrothiophenium chloride) is thermally converted into PPV by elimination of tetrahydrothiophene and hydrochloric acid. The poly(p-xylenetetrahydrothiophenium chloride) exhibits about 50% of weight loss by heating from room temperature to 300° C. due to the elimination of tetrahydrothiophene and hydrochloric acid. The sample heat-treated at 250° C. for 12 h scarcely show weight loss in this temperature range, indicating the sample is completely converted into PPV. On the other hand, the weight loss above 500° C. observed for both samples is considered as the decomposition or graphitization of PPV.

Figure 6:
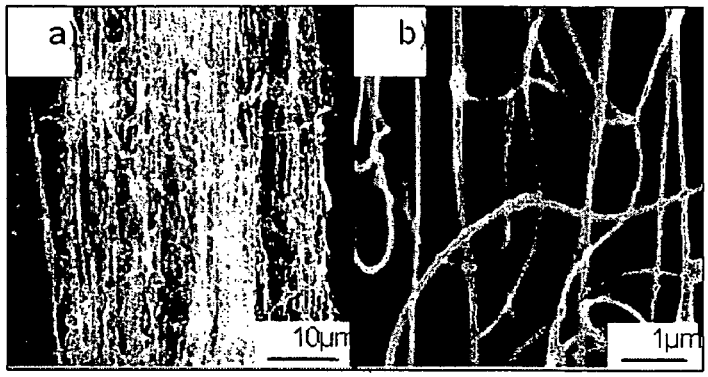
FIG. 6 shows SEM image of PPV nanofibers.

FIG. 6 shows SEM images of PPV solid fibers obtained by heat treatment of poly(p-xylenetetrahydrothiophenium chloride). The diameter of PPV fibers is 50-200 nm where the fiber preserves the fibrous morphology even after elimination of tetrahydrothiophene and hydrochloric acid. It is seen that a number of PPV solid fibers are entangled to form bundles with a diameter of about 50 μm. It is also found that the nanofibers are aligned along the axis of the bundle.

EXAMPLE 2

The solid fibers of conducting polymer precursor, poly(p-xylenetetrahydrothiophenium chloride), are produced by electrospinning in the same manner described in EXAMPLE 1. Then the PPV fibers are produced by using "zone reaction method"instead of heat treatment at 250° C. for 12 h in a vacuum used in EXAMPLE 1.

Figure 7:
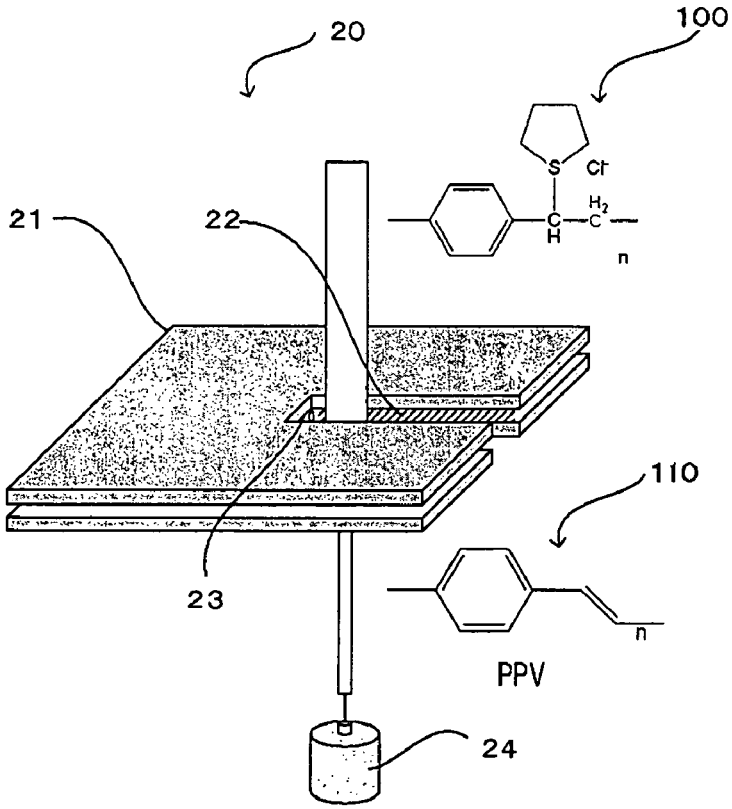
FIG. 7 illustrates conversion of precursor into vinyl-type conducting polymer by zone reaction method.

FIG. 7 shows schematic diagram of principle of the "zone reaction method". The solid fibers of poly(p-xylenetetrahydrothiophenium chloride) are converted to PPV by applying a tension at the bottom end of the fibers and followed by passing in the narrow band heater. This method has the following advantages compared with the heat treatment in a vacuum described in EXAMPLE 1: (1) the heat and tension act locally and effectively on the sample; (2) the thermal decomposition or oxidation of the sample can be minimized because the heating time, about a few seconds, is more than four orders of magnitude shorter compared with the conventional method; and (3) various thermal reactions or removal of solvent can be performed simultaneously with drawing and orientation of the sample. Instead of the electric heater, laser, microwave, torch, and Peltier device can be used as the zone heater. Above all, easily available electric heater is the most practical method for heating.

Figure 8:
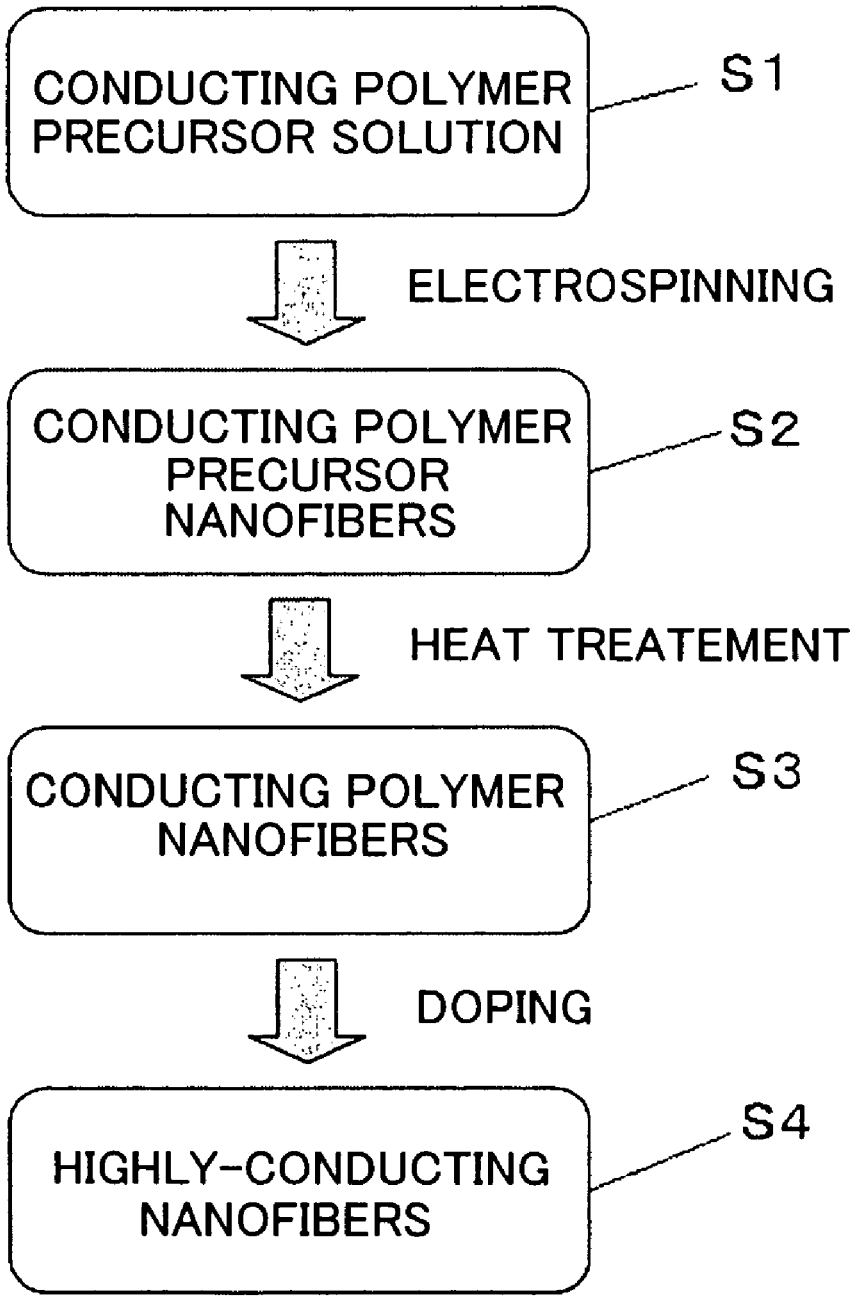
FIG. 8 is a flow chart describing the preparation of vinyl-type conducting polymer fibers.

The above whole process to produce vinyl-type conducting polymer fibers is described using a flow chart as shown in FIG. 8. First, the solution of vinyl-type conducting polymer precursor is prepared, and then dissolved in volatile solvent such as methanol (S1).

Next, the solid fibers of vinyl-type conducting polymer precursor are produced by electrospinning (S2). The resulting solid fibers are heat-treated in a vacuum or in an inert gas atmosphere (S3). The heating temperature and heating time are generally 250° C. and 12 h, respectively. Instead of this heat treatment, the heat treatment by zone reaction can be utilized.

Through the above process, the vinyl-type conducting polymer fibers are produced. In this process, the diameter of vinyl-type conducting polymer fibers can be regulated by controlling the concentration of solution, applied voltage, distance between the tip of the nozzle and the target, and the shape of the emitting nozzle.

By general doping, for example, by immersing the sample to the dopant solution for 5 min~1 hour, the electrical conductivity of the resulting vinyl-type conducting polymer fibers can be improved (S4). The dopant used in the doping is, for example, at least one chosen from sulfuric acid, hydrochloric acid, nitric acid, phosphoric acid, iodine, bromine, arsenic fluoride, perchloric acid, tetrafluoroboric acid, hexafluorophosphoric acid, toluenesulfonic acid, dodesylbenzenesulfonic acid, perfluorosulfonic acid, polystyrenesulfonic acid, and their derivatives. Above all, sulfuric acid (18 mol/l) is preferable because high conductivity can easily be achieved.

This invention can be used not only in all organic electronic devices such as organic electroluminescence, organic transistors, and organic solar cells but also as an antenna of IC tags and electrical wires of IC tips. It is also considered to be applied to fibers for anti-static clothes, carrier boxes for devices being easily broken by static electricity such as IC tips, and to many products and fields.

What is claimed is:

1. A method for producing aligned conducting polymer fibers with vinyl described in general formula (2), comprising the steps of:

dissolving a vinyl-type conducting polymer having an aromatic or heterocyclic hydrocarbon in a main chain and an elimination group in a side chain described in general formula (1) in a solution containing a volatile solvent;

producing fibers of the vinyl-type conducting polymer by electrospinning; and eliminating the elimination group by heat treating the fibers:

(1)

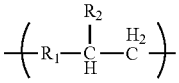

-continued (2)

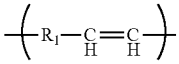

wherein, in formulas (1) and (2), R1 represents an aromatic or heterocyclic hydrocarbon and R2 an elimination group.

2. A method for producing aligned conducting polymer fibers with vinyl described in general formula (2), comprising the steps of:

dissolving a vinyl-type conducting polymer precursor described in general formula (1) in a solution containing a volatile solvent;

producing fibers of the vinyl-type conducting polymer precursor by electrospinning; and heat treating the fibers:

(1)

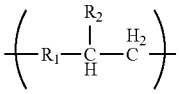

(2)

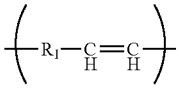

wherein, in formulas (1) and (2), R1 represents an aromatic or heterocyclic hydrocarbon and R2 an elimination group, and wherein the solution consists essentially of the volatile solvent and the vinyl-type conducting polymer precursor.

3. The method for producing conducting polymer fibers with vinyl according to claim 2, wherein said solution contains 40-90 wt % of volatile solvent.

4. The method for producing conducting polymer fibers with vinyl according to claim 2, wherein said heat treating is performed above 200° C. for longer than 1 hour.

5. The method for producing conducting polymer fibers with vinyl according to claim 4, wherein said heat treating is performed in a vacuum or in an inert gas atmosphere.

6. The method for producing conducting polymer fibers with vinyl according to claim 2, wherein said heat treating is performed on the fibers in air by successive heating of a part of the fibers under application of a tension to the fibers.

7. The method for producing conducting polymer fibers with vinyl according to claim 2, wherein the electrospinning is performed with a needle electrode at a position normal to a plate electrode, and wherein the conducting polymer fiber grows perpendicularly to the plate electrode and parallel to the needle electrode.

8. The method for producing conducting polymer fibers with vinyl according to claim 2, wherein the volatile solvent is selected from the group consisting of alcohols, ketones, aldehydes, nitryls, ethers, dimethylformamides and alkyl monohalides.

9. The method for producing conducting polymer fibers with vinyl according to claim 2, wherein the volatile solvent is methanol.

10. A method for producing aligned conducting polymer fibers with vinyl, comprising the steps of:

dissolving a vinyl-type conducting polymer precursor described in general formula (1) in a solution containing a volatile solvent;

producing fibers of the vinyl-type conducting polymer precursor by electrospinning;

heat treating the fibers to produce conducting polymer fibers with vinyl described in general formula (2); and subjecting the conducting polymer fibers with vinyl to doping processing:

(1)

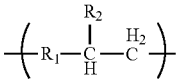

(2)

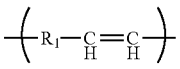

wherein, in formulas (1) and (2), R1 represents an aromatic or heterocyclic hydrocarbon and R2 an elimination group, and wherein the solution consists essentially of the volatile solvent and the vinyl-type conducting polymer precursor.

11. The method for producing conducting polymer fibers with vinyl according to claim 10, wherein said doping processing is performed using sulfuric acid as a dopant.

12. The method for producing conducting polymer fibers with vinyl according to claim 10, wherein the solution contains 40-90 wt % of volatile solvent.

13. The method for producing conducting polymer fibers with vinyl according to claim 10, wherein said heat treating is performed above 200° C. for longer than 1 hour.

14. The method for producing conducting polymer fibers with vinyl according to claim 13, wherein said heat treating is performed in a vacuum or in an inert gas atmosphere.

15. The method for producing conducting polymer fibers with vinyl according to claim 10, wherein said heat treating is performed on the fibers in air by successive heating of a part of the fibers under application of a tension to the fibers.

16. The method for producing conducting polymer fibers with vinyl according to claim 10, wherein the electrospinning is performed with a needle electrode at a position normal to a plate electrode, and wherein the conducting polymer fiber grows perpendicularly to the plate electrode and parallel to the needle electrode.

17. The method for producing conducting polymer fibers with vinyl according to claim 10, wherein the volatile solvent is selected from the group consisting of alcohols, ketones, aldehydes, nitryls, ethers, dimethylformamides and alkyl monohalides.

18. The method for producing conducting polymer fibers with vinyl according to claim 10, wherein the volatile solvent is methanol.

* * * * *